US011278065B2

(12) United States Patent
Hubbs

(10) Patent No.: US 11,278,065 B2
(45) Date of Patent: Mar. 22, 2022

(54) INTEGRATED COOLING AND HYDRATION VEST

(71) Applicant: William O. Hubbs, Cedar Hill, MO (US)

(72) Inventor: William O. Hubbs, Cedar Hill, MO (US)

( * ) Notice: Subject to any disclaimer, the term of this patent is extended or adjusted under 35 U.S.C. 154(b) by 137 days.

(21) Appl. No.: 16/602,880

(22) Filed: Dec. 18, 2019

(65) Prior Publication Data

US 2020/0196687 A1 Jun. 25, 2020

Related U.S. Application Data

(60) Provisional application No. 62/917,729, filed on Dec. 21, 2018.

(51) Int. Cl.
*A41D 13/005* (2006.01)
*A41D 1/04* (2006.01)

(52) U.S. Cl.
CPC ..... *A41D 13/0053* (2013.01); *A41D 1/04* (2013.01)

(58) Field of Classification Search
CPC ..... A41D 13/0053; A41D 13/0056; A41D 13/0058; A41D 1/04; A41D 19/0079; A45F 2003/166
USPC ..... 2/102
See application file for complete search history.

(56) References Cited

U.S. PATENT DOCUMENTS 2,470,031 A * 5/1949 Harris ..... A41D 1/22 2/76
2,591,513 A * 4/1952 Cormier ..... A41D 1/21 2/74
3,261,042 A * 7/1966 Baker ..... B63C 9/115 441/112
3,610,323 A * 10/1971 Troyer ..... A41D 13/0053 165/46
3,950,789 A * 4/1976 Konz ..... A41D 13/0055 2/93
D274,670 S * 7/1984 Smith ..... D2/743
5,085,349 A * 2/1992 Fawcett ..... A45F 3/20 220/703
5,146,625 A 9/1992 Steele et al.
5,415,222 A * 5/1995 Colvin ..... F28D 20/02 165/46
5,438,707 A 8/1995 Horn
5,524,293 A 6/1996 Kung
5,603,727 A 2/1997 Clark et al.
5,755,110 A * 5/1998 Silvas ..... A41D 13/0053 165/46
6,185,744 B1 * 2/2001 Poholski ..... A41D 13/0058 2/102

(Continued)

*Primary Examiner* — Alissa L Hoey
(74) *Attorney, Agent, or Firm* — Paul M. Denk

(57) ABSTRACT

An integrated cooling and hydration vest, incorporating a vest like structure made from liquid impervious material, the vest having at least one chamber formed therein, the chamber being structured into an upper section and a bottom section, a divider provided between the upper and bottom sections, at least one aperture provided through the divider to allow frozen material deposited within the upper section as it melts to gravitate into the bottom section during usage, and a syphoning device operative being associated with said chamber to allow the user to extract the melted liquid from the bottom section for consumption during usage.

6 Claims, 1 Drawing Sheet

(56) References Cited

U.S. PATENT DOCUMENTS 6,189,149 B1 * 2/2001 Allen ..... A41D 13/0055 2/102
6,220,490 B1 * 4/2001 O'Hara ..... A45F 3/16 2/102
6,282,717 B1 * 9/2001 Ng ..... A41D 1/04 2/115
6,931,875 B1 8/2005 Allen et al.
D539,027 S 3/2007 Gressock et al.
D599,529 S 9/2009 Simpson
7,665,156 B1 * 2/2010 Hewitt ..... A41D 13/0518 2/462
7,762,096 B2 7/2010 Fuchs
7,896,199 B2 * 3/2011 Kaczmarek ..... B65D 75/5877 222/94
D640,466 S 7/2011 Staton
8,267,283 B2 9/2012 Staton
9,179,719 B1 * 11/2015 Goldberg ..... A41D 13/0015
9,717,287 B2 8/2017 DiBernardo et al.
10,098,391 B2 * 10/2018 Gordon ..... A41D 1/04
10,709,184 B2 * 7/2020 Moore ..... A41D 23/00
2002/0112499 A1 * 8/2002 Goldfine ..... B32B 5/26 62/316
2002/0124294 A1 * 9/2002 McKenzie ..... A41D 13/0002 2/69
2004/0065703 A1 4/2004 Bellucci
2004/0244412 A1 * 12/2004 Trinh ..... A61F 7/103 62/530
2005/0251090 A1 * 11/2005 Hoskins ..... A45F 3/16 604/76
2006/0174392 A1 * 8/2006 Farnworth ..... A62B 17/005 2/102
2006/0201178 A1 * 9/2006 Smolko ..... F25D 7/00 62/259.3
2009/0062892 A1 * 3/2009 Llcheva ..... A41D 13/0518 607/108
2010/0011489 A1 * 1/2010 Goldmann ..... A41D 13/00 2/455
2010/0011491 A1 * 1/2010 Goldmann ..... A41D 13/002 2/458
2010/0018682 A1 * 1/2010 Goldmann ..... F28D 21/0015 165/104.31
2010/0101253 A1 * 4/2010 Searle ..... F25D 31/002 62/259.3
2012/0171912 A1 * 7/2012 Ewing ..... B63C 9/11 441/106
2012/0246788 A1 * 10/2012 Harrell ..... A41D 13/0155 2/2.5
2013/0247271 A1 * 9/2013 Bowen ..... A41D 15/04 2/144
2013/0284762 A1 * 10/2013 Voss ..... A45F 3/16 222/175
2014/0157484 A1 * 6/2014 Ezell ..... A41D 13/0058 2/102
2015/0060502 A1 * 3/2015 Murrey ..... A45F 5/02 224/148.2
2017/0266038 A1 * 9/2017 Peavy ..... F24F 5/0017
2019/0110528 A1 * 4/2019 West ..... A41D 3/00
2020/0237027 A1 * 7/2020 Morris ..... A41C 3/0028
2020/0329851 A1 * 10/2020 Espeland ..... A45F 3/04
2020/0329852 A1 * 10/2020 Worcester ..... B67D 1/0805
2020/0397072 A1 * 12/2020 Arnold ..... A41D 13/0053
2021/0137181 A1 * 5/2021 Patel ..... A41D 31/125

* cited by examiner

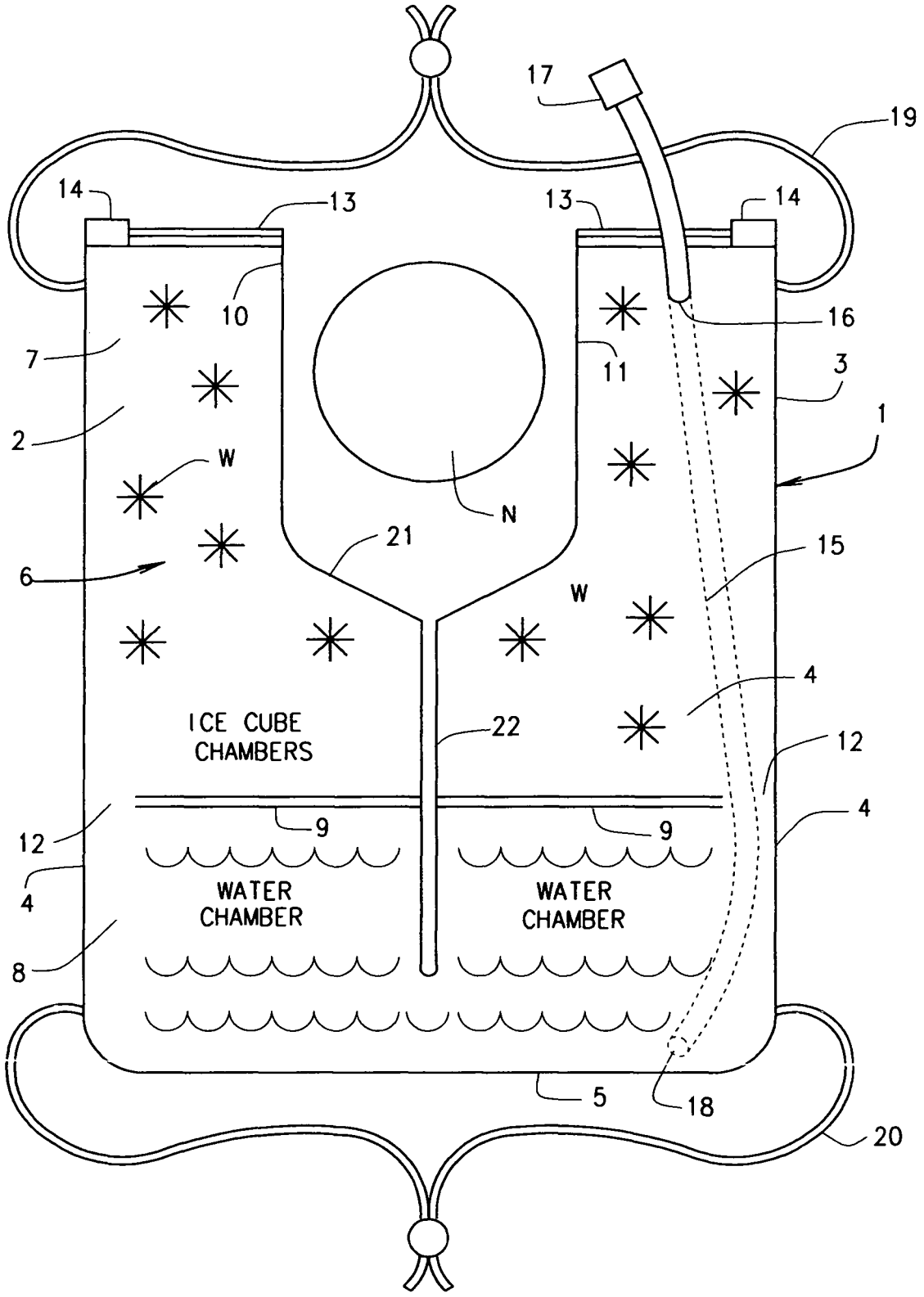
17
19
14
13
13
14
10
16
7
11
3
2
1
W
N
21
15
6
W
4
ICE CUBE
CHAMBERS
22
12
9
9
4
12
4
WATER
CHAMBER
WATER
CHAMBER
8
5
18
20

INTEGRATED COOLING AND HYDRATION VEST

CROSS REFERENCE TO RELATED APPLICATION

This is a nonprovisional patent application that claims priority to the provisional patent application having Ser. No. 62/917,729, filed on Dec. 21, 2018.

FIELD OF THE INVENTION

This invention relates to an integrated cooling and hydration vest, and more particularly one that can provide for the insertion and retention of frozen material, such as ice, in an upper compartment of the vest, which when the ice melts, delivers its fluid by gravity to a lower section of the vest, and a straw or other suction device that extends out the approximate upper portion of the vest, having its lower end provided near the bottom interior of the vest, allows the wearer to suck cooling liquid from the vest for consumption.

BACKGROUND OF THE INVENTION

This invention, as stated, comprises an integrated cooling and hydration vest. It can be used for both providing for the transmission of a cool feeling to the upper regions of the wearer, and at the same time, when the frozen material contained therein melts, it is delivered by gravity to the bottom of the vest, and which liquids can be siphoned therefrom by means of a straw like member for consumption by the vest wearer, during its usage and application.

There are a variety of hydration means, cooling means, and related types of structures, that are available in the art. The concept of the current invention is to integrate these into a singular structure, for achieving both results.

All attendees at various outdoor events, particularly during the hot summer months, such as at a sporting event, have found themselves both uncomfortable, if not miserable, while watching the progress of the event. Anyone who has attended a baseball game, at any level, during the hot days of July, can attest to the discomfort that is experienced when exposed for a prolonged period of time to such heat.

Such a participant, as a spectator, can find it quite miserable to be in attendance.

As a way to combat such excessive heat, as done in the prior art, has been to wrap a wet towel around one's neck. It definitely works, but it makes for a wet mess. In later times, items such as the evaporative products have been available. They may work for some period of time to cool the user, but its useful results are limited to just personal cooling, and have no other attributes. There have been a variety of prior art devices that have been introduced for personal cooling purposes.

As stated, various types of personal cooling means have been available, such as evaporative cooling towels, evaporative neck coolers, evaporative bandanas, evaporative dew rags, and evaporative cooling vests. All require water and evaporation, but do not give any consideration for rehydration.

There are a number of hydration packs, backpacks, that are provided to carry water for hydration, but just do not provide for a way to cool the body, simultaneously. There are cooling gel packs that can be inserted into folders, that can be wrapped around the next of the wearer to cool, but these must be frozen, but obviously their chemicals do not provide for any rehydration.

There is an electronic collar on the market, that is called the black ice personal neck cooler. It is necessary to recharge the item, and it must be placed in a deep freeze to prepare it for reuse. These items are quite costly.

Finally, there is a patented item called a flexi freeze ice vest. The vest has many water pockets in it, which when frozen, the water pockets create ice cube pockets, that contact and cool the body. The item though is quite bulky and costly, and furthermore, does not provide for hydration.

The current invention, as envisioned by the inventor, had its concept and idea come to him at a professional baseball game. It was a miserably hot day, and the spectator was both hot and thirsty. The thought of a wet towel around his neck came to mind, but it would not be a pleasant way to cool, and he would be wet and in a short time the water in the towel would warm up, and would have to be replenished. The idea did not sound too favorable. In addition, there was no way to hydrate, other than buying a container of a beverage, at high price. The inventor looked around the stadium and realized that there probably about 40,000 other people, in only this stadium, that more than likely felt the same way. Therefore, he found a need to address this particular problem, so as to satisfy the masses.

One such prior art patent that relates to the subject matter of this invention, but only from the temperature controlling standpoint, is shown in the U.S. Pat. No. 5,603,727, to Clark, identified as a thermal pack with interrelated compartments. Apparently this device, which is defined as being a thermal pack, incorporates a natural temperature retaining material, which is identified as corn, and has various barriers and communicating compartments for easily locating the temperature retaining materials therein, during usage. Apparently this device is primarily for use for medical purposes. The device is described for use more for heat retention purposes, and again, in the health care industry.

The patent to Staton, upon a personal hydration system, U.S. Pat. No. 8,267,283, shows a personal hydration system. It has a fluid reservoir, incorporating spaced apart apertures, with a flexible tube, that apparently provides means for withdrawing liquid from the fluid reservoir.

The patent to Fuchs, U.S. Pat. No. 7,762,096, shows a temperature control vest having visible ice sheets composed of refrigerant cubes. This is a temperature controlled vest having these visible ice sheets composed of refrigerant cubes, is more an item of clothing, rather than a disposable type of polymer pouch, as described for the current invention.

The design patent to Simpson, No. D599,529, shows another cooling vest for gel pack inserts. It does not give consideration to hydration of the user.

The patent to Allen, et al., shows a cooling vest system, U.S. Pat. No. 6,931,875, that shows a series of pockets that hold cooling packs, during usage.

U.S. Pat. No. 9,902,605, to Lux, is upon a hydration system, and appears to have far more electric and mechanical features, in its structure, for delivery of a liquid to the user.

The U.S. Pat. No. 9,717,287, shows another cooling garment, and is a climate controlled type of garment.

The published application No. US2004/0065703, shows an athletic hydration pack. This particular device includes a strap, that holds the bladder, and which can be secured around the waist or over the shoulder of the athlete.

Another design Pat. No. D539,027, shows a combined hydration cap and mount. This device shows what looks like a hose, for removing a liquid from a container.

Another cooling vest is shown in the patent to Kung, U.S. Pat. No. 5,524,293.

Another body cooling apparatus is shown in the patent to Horn, U.S. Pat. No. 5,438,707.

An even more complex cooling vest is shown in the patent to Steele, et al., U.S. Pat. No. 5,146,625.

There are many other prior art disclosures that show various types of hydration dispensing devices, and separately cooling packs, as are known in the art. But, many of these are far more complex than the structure of the current invention, and have no disposability features about them.

These are what prior art publications that are known to the inventor relating to the subject matter of this concept.

SUMMARY OF THE INVENTION

This invention primarily relates to the concept of cooling a segment of the body, and to also provide means for rehydration of the person, all integrated into a singular structure, and which may be made of inexpensive components that make the device disposable, notwithstanding the beneficial results that can obtained from the invention, during its usage and application.

The concept of this invention is to provide an inexpensive polymer bladder, which may be formed of a polyethylene, polypropylene, or other polymer film, and which can have its operative compartments easily structured from it, or secured to it, such as forming the various components of the device through heat sealing during its fabrication. The invention is an inexpensive polyethylene bladder, in the preferred embodiment, which includes a freezer type bag or zip lock form of attachment at the top edge(s) of the bladder, which is formed into the structure of a simulated vest, formed as a chamber, having upper and bottom sections, which as stated, may be sealed together, or even heat sealed during its formation, to form the internal bladder for the vest when formed. The bladder may include an upper freezer containing bag, which may have a form of attachment at its top edge, such as the known Ziplock type of securement, and the bladder includes a pair of an upper and lower or bottom section, in its structure. There will be a divider provided between the upper section and the bottom section, so that when ice cubes are applied through the Ziplock attachment along the upper edge of the upper section, they are contained within said upper section, and gradually will melt during usage of the vest. The divider provided between the upper and lower sections may have at least one aperture provided therein, so that when the ice deposited within the upper section, melts, its water or other fluids generated will gravitate into the bottom section of the vest, and therein provide a cold fluid or liquid for consumption by the vest user, during its application. Obviously, the fluids generated within the vest, can be frozen water, frozen sodas, frozen fruit juices, almost any type of liquid that will freeze, and provide by convection the transmission of coolant to the exterior of the formed vest, to the benefit of the wearer, and at the same time, as the ice slowly melts, and its fluid gravitates into the bottom section, that fluid is available for consumption, to furnish a rehydration of the vest user, during its application. Obviously, there may be one or more baffles or dividers provided internally of the chamber, and there may be one or more apertures or pathways provided through the divider, to allow for the gradual flow of the melted fluids, by gravity, into the bottom chamber.

A suction means, such as an integral straw, will extend from the lower area of the bottom section, and upwardly for extending adjacent the upper section and outwardly thereof, to furnish a straw and in proximately with the head of the user, so that the straw like member can be inserted into the mouth, and suction will draw the melted fluids from the bottom section, for the purpose of furnishing cold liquid rehydration of the vest user, during its application and usage.

Thus, for the structure as generally described herein, it can be readily determined that the integration of all of its components together, within an inexpensively constructed polymer type of vest, not only furnishes cooling to the user, but a means for rehydration of liquids, and at the same time, all from a disposable type of vest, which, after usage, may be discarded.

Obviously, other combinations of the polymer film to form the vest may be considered, there may be an upper chamber that may have a pair of sections, into which the iced material may be inserted, and there may be a pair or more of lower sections, into which liquid may deposit, as the iced material melts during usage of the vest for its useful purposes.

Obviously, the primary, emphasis of the invention is to put ice cubes, of water, in the upper section of the vest chamber, so that ice water may be deposited in the bottom section, as the vest is continuously worn, and to furnish that refreshing cold water to the user, in the manner as described herein, during usage of this invention.

In its application, the vest may have extended upper sections that rest upon the upper shoulders of the user, and may have a tie means or clasp provided along the back upper edges, so as to secure the vest to the neck of the wearer, in preparation for its application and usage. In addition, there may be a tie means provided at the bottom of the vest, and which allows it to be secured around the waist of the user, in order to adhere the vest contiguously against the upper chest of the wearer, in order to attain the cooling effects during its usage, and to furnish the accumulated ice water for rehydration purposes.

In the design of the vest of this invention, the chamber, as stated, may have a zipper like attachment along the upper edge of the freezer bag, such as that know as the Zip-lock type of connector, as known in the art. This allows the freezer bag to be easily opened, and filled, with the iced material, in preparation for its usage. The freezer chamber of the vest containing its ice cubes eventually becomes a freezer bag of cold water, particularly in its bottom section. If a pair of such upper sections are forming the chamber, the ice cubes of the two upper sections of the bag will flow its melted cold water into the bottom section, for eventual withdrawal and consumption.

Located at the upper segment of the vest, is this neck portion, which has its strap formed around the neck, so as to hold the vest upwardly as near as possible to the neck, and the upper chest during usage. The ice cubes being held upwardly in the freezer chamber, while the water melts and falls by gravity to the bottom section of the vest, does provide a dual purpose of the invention, and that is for cooling purposes, and hydration purposes, during its application and usage. The iced material in the upper sections of the chamber secure the upper portions of the freezer vest in the vicinity of the wearer's neck, with the divider or baffle integrally formed within the chamber provides just enough open area, as explained, to allow for the melted water or other fluids to flow into the bottom section, gradually, during usage. The upper area of the vest may be slightly larger in order to hold the iced material in the vicinity of its desired usage, upon the wearer, and then the lower section is designed to collect the melted water or fluids, therebelow, as noted. The ice cubes that have melted and flown into the bottom section can then be evacuated with one or more straw like members, whether they be integrated into the structure of the vest, or just secured proximate its top edge, extending therethrough, and extending to the bottom interior of the lower section of the vest, to allow for evacuation of its liquid contents, as desired, and as needed for rehydration purposes. Obviously, if the bottom section is unitary, and all the melted water or fluids flow into that bottom section, then only a singular drinking straw, integrated into the structure of the vest, may be required, for evacuation of the fluids during consumption. It is believed that the volume of iced material that is located within the upper section of the vest, may provide sufficient time for hydration of the user over a reasonably long period of time, into the gradual melting of the iced material, within that upper section of the vest. The ice and cold water provided within the vest, furnishes cooling through its contact with the upper chest area of the user, and also provides for his/her hydration, as required.

It is, therefore, the principal object of this invention to provide an integrated cooling and hydration vest for use by the wearer, particularly during exposure to warmer or hot atmospheric conditions.

Another purpose of this invention is to provide an inexpensive type of vest, when produced, so that it can even just be given away, for use for advertising purposes.

Another object is to provide an integrated vest, in which team or company colors or logos may be imprinted or applied thereto.

Another area of usage of this invention would be to promote sports teams, motor sports, outside laborers, highway workers, which may include proper cautionary colors and reflective striping, motorcycle riding, bicycle riding, for joggers, or even when applied for outside yard work chores.

This particular invention may have worldwide interest especially relative to the enormously promoted and attended soccer matches, conducted throughout the world.

Various types of straps or drawstrings may be secured to the upper and lower sections of the vest, to apply it around the back of the neck of the wearer, or around the waist, to hold the bottom of the vest against the user, during its application.

The strap applied to the bottom of the vest may be adjustable, in order to be secured to the body of the person regardless of their size or condition.

Insulation may be applied to certain areas of the vest, in order to make the item less cold for comfort, and to provide temperature regulation.

With the vest of this invention, and even though it may be disposable, at sporting events, the sponsors may even be able to sell the ice or other iced material, for initial fill or refills of the vest, throughout the conduct of the game.

It could even be possible that at sporting events, beer could even be applied into the vest, and to serve as a cooling fluid, and to also function as a novelty to allow for its consumption.

Obviously, the user can put whatever beverage they prefer into the vest, during its assembly.

It may also be possible that the various baffles or dividers provided between the upper section and the lower section of the vest, may be removed, so that entire chamber may be filled with a beverage, to add to the cooling effect of the user, and to furnish the fluid necessary for rehydration.

These are just examples of the variations of usage of this current invention, and which adds to the novelty of usage of the device, for the multiple purposes as described herein.

Other objects and purposes may become apparent to those skilled in the art upon review of the summary of the invention as provided herein, and upon undertaking a study of the description of its preferred embodiment, in view of the drawings.

BRIEF DESCRIPTION OF THE DRAWINGS

In referring to the drawings,

FIG. 1 provides a front view of the integrated cooling and hydration vest of this invention.

DESCRIPTION OF THE PREFERRED EMBODIMENT

In referring to the drawings, in FIG. 1, therein is shown the integrated cooling and hydration vest 1 of this invention. It includes a vest-like structure, as noted, formed of a pair of layers of polymer material, having a front layer 2 and a back layer 3, sealed together around their edges 4 as can be noted. The sealing may be done by heat sealing, simply folding over the polymer layers onto each other, wherein the fold will form one side edge, and the heat sealing will be provided upon the opposite side edge, and along the bottom edge 5. The formed chamber 6 between the two layers has an upper section 7 and a lower section 8, and there is a divider or baffle 9 provided between the two sections of the chamber, for purposes to be subsequently described. In addition, the upper section 7 of the chamber may be bifurcated, as noted at 10 and 11, in order to provide clearance for the wearer's neck, as can be noted at N.

It can be seen that the divider 9 has clearance areas, or apertures, provided laterally, as noted at 12, or it is just as likely that the apertures may be provided anywhere along the length of the divider 9, as can be understood.

As previously summarized, the purpose of the various sections of the chamber, is to provide for the deposit of cubes of iced material, such as water, as generally noted at W, deposited through the upper edge 13 of the device, for locating within the upper section 7, as noted, and then as the ice melts, it can pass through the clearance areas or apertures 12, as noted, to deposit its cold liquid, such as water, into the bottom section 8, of the vest, as previously explained.

It can be seen that the upper edges 13 of the vest may have means for opening and closing of the vest at this location, through the use of a Zip lock, or other forms of connector, as noted at 14, so that the upper edges 13 may be opened, have their iced material deposited therein, and then reclosed, so as to prevent any leakage from the vest at this location.

In addition, it can be seen that there is a straw like means 15 that extends through the upper region of the vest, as noted at 16, and has an upper capped end 17 while the lower end of the straw like member 15 extends to the bottom of the lower section of the chamber, as noted at 18. Thus, when there is an accumulation of melted water or other fluids into the bottom of the chamber, the wearer of the vest may simply remove the cap 17, and suck such fluids up through the straw like member 15, to provide for hydration or rehydration of the wearer, during usage of this device.

Hence, as can be understood, not only does the vest provide for cooling of the wearer, through the location of its ice or other material frozen cubes W, in the upper section of the chamber, while at the same time, eventually furnishing a means for rehydration, from the accumulation of melted fluids, such as water, in the bottom section 8 of the chamber, during its usage.

It can be seen there are means for securement of the vest to the wearer. There is a neck drawstring 19 furnished at the upper end, and which may fit around the back of the neck of the wearer, and adjusted, as a drawstring, at that location. There is also a drawstring provided at the bottom, as noted at 20, and it can be tightened, around the waist or stomach of the wearer, to provide for contiguity of the vest against the front surface of the chest of the wearer, during its usage.

It can also be seen that there may be a clearance area, as noted at 21 formed of the chamber, and has an extension as noted at 22 that extends downwardly within the vest, in order to provide flexibility of the vest, as it is fitted around the neck area of the wearer, in preparation for its usage and application.

While the concept of the invention has been described, in the preferred embodiment, as utilizing polymer material, of the inexpensive type, so as to make the formed vest also disposable, it is just as likely that a more permanent type of vest can be constructed, from moisture resistant treated cloth, vinyl, or other more substantial material to make the vest more sustainable of usage. In addition, and while there is shown an upper section for the chamber, and a singular lower section for the vest chamber, it is just as likely that there may be a plurality of such compartments provided throughout the structure of the vest, in order to perhaps add ice cubes at one location, frozen fruit juice cubes at another location, and have separated lower sections for the chamber, so that the user can withdraw by one or more straws, operatively associated with each lower section, either ice water, fruit juice, or any other frozen material that has melted and deposited its fluids into the bottom of the shown vest.

Variations or modifications to the subject matter of this invention may occur to those skilled in the art upon review of the disclosure as provided herein. Such variations, if within the spirit of this invention, are intended to be encompassed within the scope of any claims to patent protection issuing herein. The summarization of the invention as provided in this application, its specific description within the preferred embodiment, and its disclosure within the drawing, are set forth for illustrative purposes only.

I claim:

1. A disposable integrated cooling and hydration vest, including a vest like structure made from a liquid impervious material, said vest as formed having at least one chamber formed therein, said chamber being structured into various segments, an upper section formed to hold frozen but meltable liquid material therein, and incorporating at least one upper edge closure, a bottom section formed to directly hold the liquid deposited by gravity from the melted liquid material provided within the upper section of said chamber, a divider permanently integrated between the said upper section and said bottom section of the chamber to separate the two sections, the upper section of the chamber is formed into two parts, and bifurcated as extending upwardly from the lower section of said vest chamber and to the upper edge of said upper section of said chamber, to allow for and accommodate the application to the upper chest and around the neck of the wearer when worn, there being at least one aperture provided through the divider separating the bifurcated upper section and said bottom section of the said chamber and provided for allowing the melted liquid to pass through the said aperture and into the bottom section of the chamber to allow accumulation of the melted liquid within said bottom section, a siphoning member being a straw member extending through the upper section and into the bottom section of said vest, an opening at a bottom end of said straw member approximate the bottom of the said bottom section, said straw member extending upwardly through the upper section and extending exteriorly approximate the location of the upper edge closure, to allow access of the wearer to extract liquid through said straw member for imbibing by the wearer of said vest, said siphoning member comprising said straw member operatively associated with said bottom section of said chamber and extending upwardly from said bottom section of said chamber of said vest and through said upper section of said chamber of said vest to allow the user to extract the melted liquid from the bottom section for consumption during usage.

2. The vest of claim 1, wherein said chamber is formed of a polymer.

3. The vest of claim 2, wherein said polymer is polyethylene film.

4. The vest of claim 1, and including a drawstring provided proximate the upper edge of the chamber, to allow for securement of the vest about the neck of the wearer in preparation for its usage.

5. The vest of claim 1, and including a drawstring provided proximate the lower edge of the chamber, to allow for the vest to be tightened about the waist of the wearer when worn.

6. The vest of claim 1 wherein said chamber, said upper and lower sections of said chamber, and said divider are formed by heat sealing.

* * * * *